United States Patent [19]

Michalik et al.

[11] Patent Number: 4,538,517

[45] Date of Patent: Sep. 3, 1985

[54] PAPER WEB GUIDING MECHANISM

[75] Inventors: Horst B. Michalik, Höchberg; Erich A. Klingenmeier, Würzburg, both of Fed. Rep. of Germany

[73] Assignee: Koenig & Bauer Aktiengesellschaft, Würzburg, Fed. Rep. of Germany

[21] Appl. No.: 536,795

[22] Filed: Sep. 28, 1983

[30] Foreign Application Priority Data

Oct. 9, 1982 [DE] Fed. Rep. of Germany ..... 3237504

[51] Int. Cl.[3] ..... B41F 13/02

[52] U.S. Cl. ..... 101/227; 101/219; 270/21.1

[58] Field of Search ..... 101/227, 228, 226, 219, 101/212, 279; 270/21.1, 20.1, 4; 400/320

[56] References Cited

U.S. PATENT DOCUMENTS

| | | | |
|---|---|---|---|
| 677,736 | 7/1901 | Firm | 270/21.1 X |
| 1,183,005 | 5/1916 | Hageman | 270/21.1 X |
| 1,284,475 | 11/1918 | Scott | 270/20.1 X |
| 1,396,872 | 11/1921 | Oberly . | |
| 1,633,691 | 6/1927 | Brueshaber | 270/20.1 X |
| 2,283,597 | 5/1942 | Clauberg | 270/21.1 X |
| 3,942,782 | 3/1976 | Hermach | 270/21.1 X |
| 4,273,457 | 6/1981 | Noda | 400/320 |

FOREIGN PATENT DOCUMENTS

| | | | |
|---|---|---|---|
| 2532168 | 2/1977 | Fed. Rep. of Germany . | |
| 684343 | 6/1930 | France . | |
| 56-65760 | 6/1981 | Japan . | |
| 0009670 | 1/1982 | Japan | 270/21.1 |
| 0023758 | of 1915 | United Kingdom | 270/4 |

OTHER PUBLICATIONS

A. Braun, Atlas des Zeitunge-U. Illustrations-Druekes 1960, Polygraph-Verlag, Frankfurt/Main.
Y

*Primary Examiner*—Edgar S. Burr
*Assistant Examiner*—James R. McDaniel
*Attorney, Agent, or Firm*—Jones, Tullar & Cooper

[57] ABSTRACT

A paper web guiding mechanism for a web-fed rotary printing machine is disclosed. The paper web guiding mechanism includes paper guide rollers and a prefeed formed roller which are substantially wider than the maximum width of the web which can be printed. Two turning bars are provided for each paper web which may be slit from the printed web. At least three formers are disposed on a common horizontal plane and are used to form the web sections that are guided to various mixed or superimposed arrays by the paper web guiding mechanism.

2 Claims, 8 Drawing Figures

PAPER WEB GUIDING MECHANISM

FIELD OF THE INVENTION

The present invention is directed generally to a paper web guiding mechanism for a web-fed rotary printing machine. More particularly, the present invention is directed to a paper web guiding mechanism for use with a plurality of formers. Most specifically, the present invention is directed to a paper web guiding mechanism in which the paper web guide roller is at least one and one quarter times as wide as the maximum width of the web being printed. The several formers of the folder are positioned side by side on the same horizontal level. At least one double turning bar and a web slitter allows the printed web to be slit and guided to the formers in a plurality of orientations.

DESCRIPTION OF THE PRIOR ART

Paper web guiding mechanisms for use in web-fed rotary printing machines are know generally in the art. The typical paper web guiding mechanism includes one or more paper guide rollers which are only slightly wider than the maximum paper width which can be accomodated by the printing couples of the printing machine. In a situation where a plurality of paper web layers are to be formed from several associated paper webs, such as may be done by slitting partial webs from one or more of a plurality of printed webs, it is necessary to provide a separate former for each such associated group of paper webs. Each such former folds the web in a longitudinal direction and these folded webs are placed one on top of the other in the folder. These folded webs are then cross cut into sections and are then again folded to form products. Such systems are often used in the placement of a printed tabloid section within a newspaper section.

In conventional web-fed rotary printing machines, the maximum plate cylinder length is the width of four pages and, as indicated previously, the roller portion of the paper web guiding mechanism has a width which corresponds to this paper web width. When such an assembly is used in the manufacture of products such as newspapers having a newspaper part and a magazine part, three or four feed formers are usually required. These formers are used in pairs and each such pair is conventionally placed above or below another pair or pairs so that the paper webs can be properly "mixed" or arranged. This conventional arrangement of the formers in a vertical stack makes the machine quite tall thereby requiring a substantial amount of space.

SUMMARY OF THE INVENTION

It is an object of the present invention to provide a paper web guiding mechanism.

Another object of the present invention is to provide a paper web guiding mechanism having a wide paper guide roller.

A further object of the present invention is to provide a paper web guiding mechanism having a plurality of formers placed adjacent each other.

Still another object of the present invention is to provide a paper web guiding mechanism which will facilitate the easy mixing of the printed paper webs.

As will be discussed in greater detail in the description of the preferred embodiment, the paper web guiding mechanism for a web-fed rotary printing machine in accordance with the present invention includes a plurality of paper guide rollers disposed between the printing couples of the web-fed rotary press and the formers of a folder assembly. The formers are disposed in a side by side horizontal array and the paper web guiding mechanism includes turning bars and web slitters. Each of the paper guide rollers is substantially wider than the maximum width of the web being printed with this roller width being at least one and a quarter times as great as the paper web width.

A particular advantage of the paper web guiding mechanism in accordance with the present invention, is that the paper webs can be mixed without the necessity of reversing them; i.e. guiding them from one forming level to another. This results in a lower position of the paper feed into the folder and the placement of the formers all at the same height. Since these formers can all be placed at the same height, a reduction in height of the assembly is provided.

BRIEF DESCRIPTION OF THE DRAWINGS

While the novel features of the paper web guiding mechanism in a web-fed rotary printing machine in accordance with the present invention, are set forth with particularity in the appended claims, a full and complete understanding of the invention may be had by referring to the detailed description of a preferred embodiment, as set forth hereinafter and as may be seen in the accompanying drawing figures in which:

DESCRIPTION OF THE PREFERRED EMBODIMENT

Figure 1:
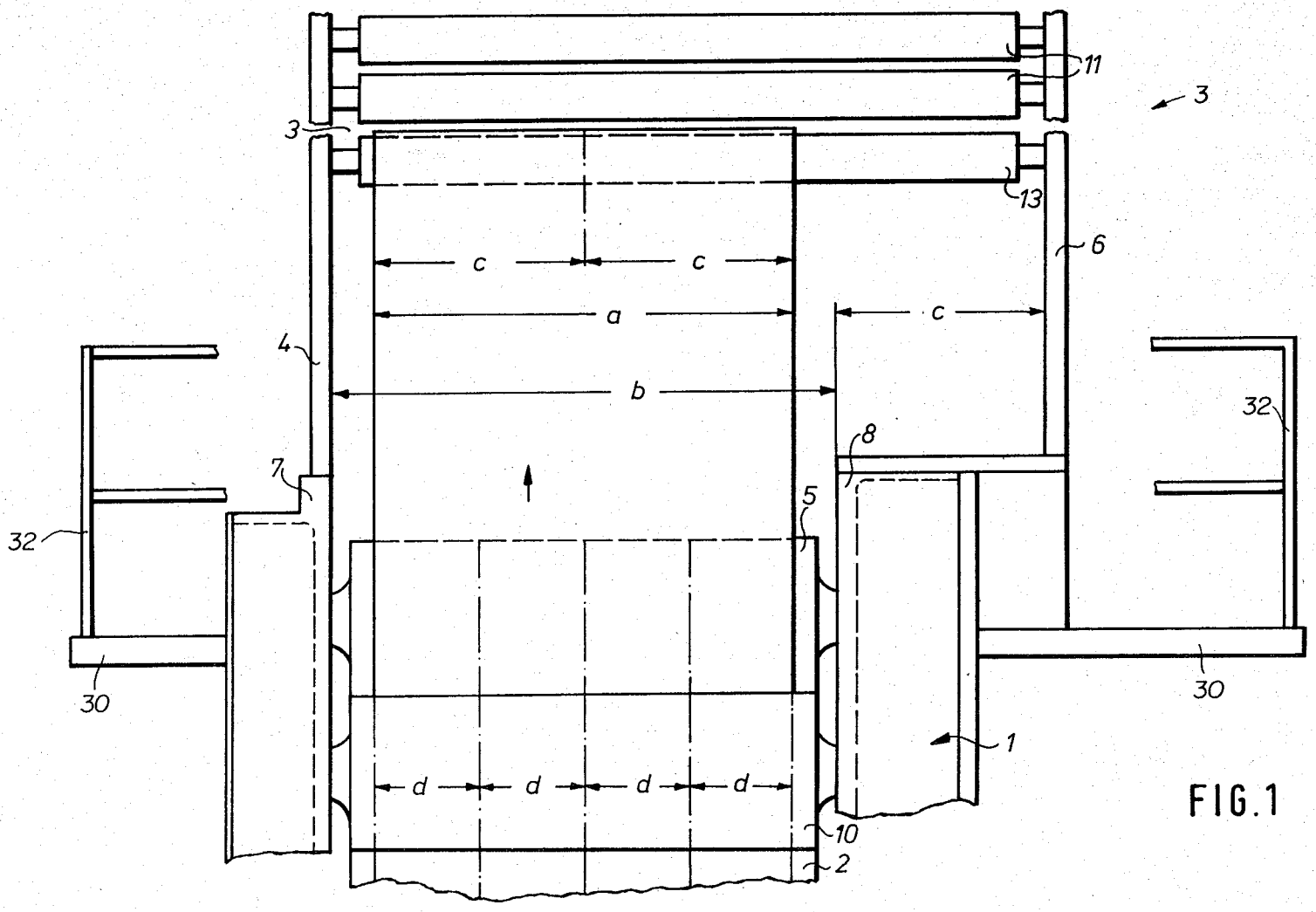
FIG. 1 is a schematic side elevation view of a printing couple having a paper web guiding mechanism in accordance with the present invention.
Figure 2:
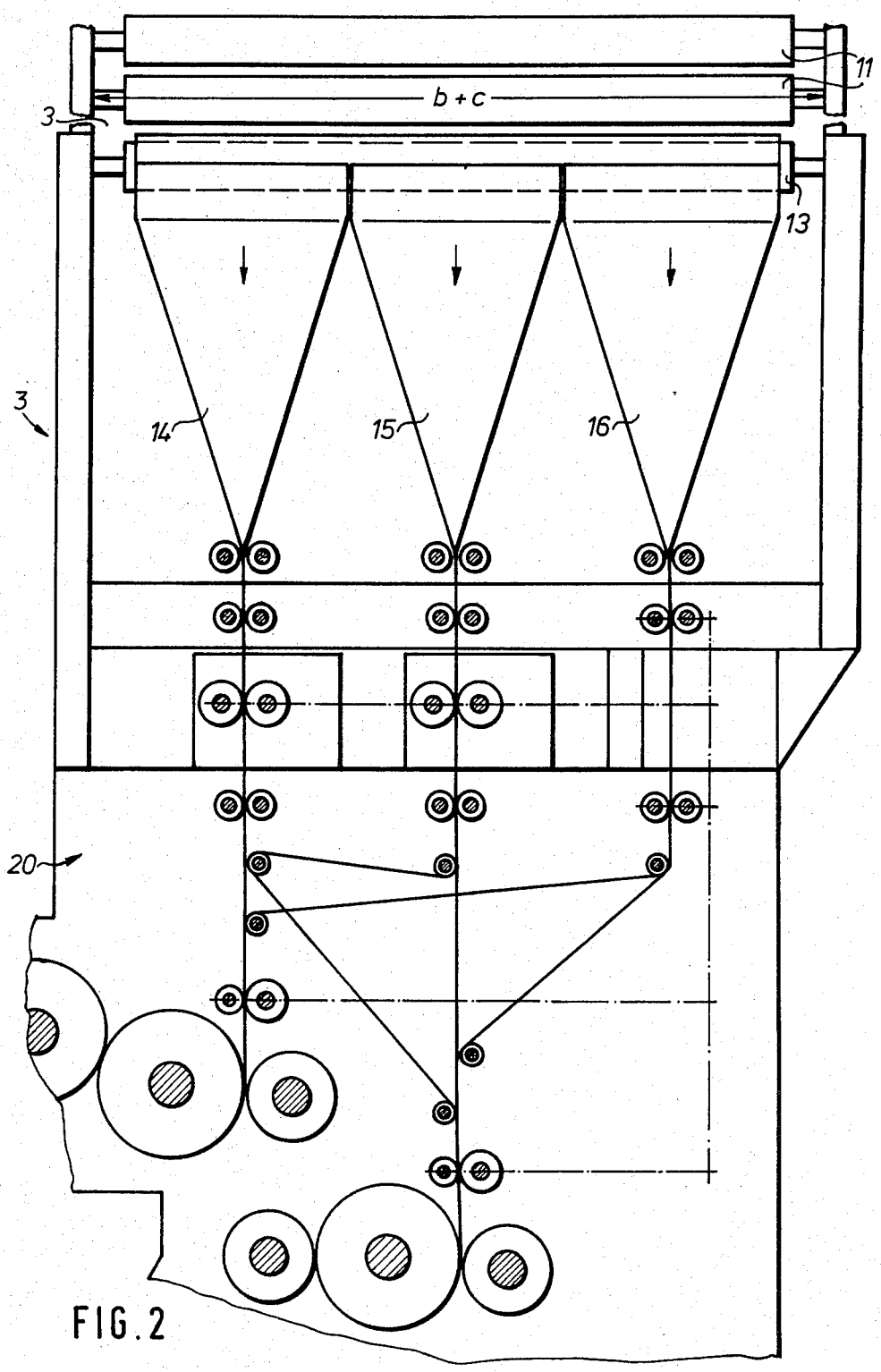
FIG. 2 is a schematic elevational view of the paper web feed from the guide roller through the formers and to a folder in accordance with the present invention.

Referring initially to FIG. 1, there may be seen a generally conventional printing couple, generally at 1 for use in a web-fed rotary printing machine. Each such printing couple 1 is comprised generally of a forme or plate cylinder 2, a blanket cylinder 10 that may be provided with a resilient cover, and a counter-pressure cylinder 5. These several cylinders are rotatably supported in side frames 7 and 8 of the rotary printing machine which may be situated on a platform 30 having safety railings 32. Each of these cylinders is generally conventional in overall size and typically has a printing width that is the width of four pages "d". A paper web guiding mechanism 3 cooperates with each such printing couple 1, as may be seen in FIGS. 1, 2 and 4. It is known generally in the art to provide paper web guiding mechanisms above printing couples in a web-fed rotary printing press. These guide mechanisms guide the paper web coming from the printing couple to a folder or to other printing couples. Conventionally, these paper web guiding mechanisms essentially comprise paper guide rollers and turning bars. A corresponding number of paper web feed rollers are positioned above the folder, as may be seen in German unexamined published application No. 2,532,168.

Figure 4:
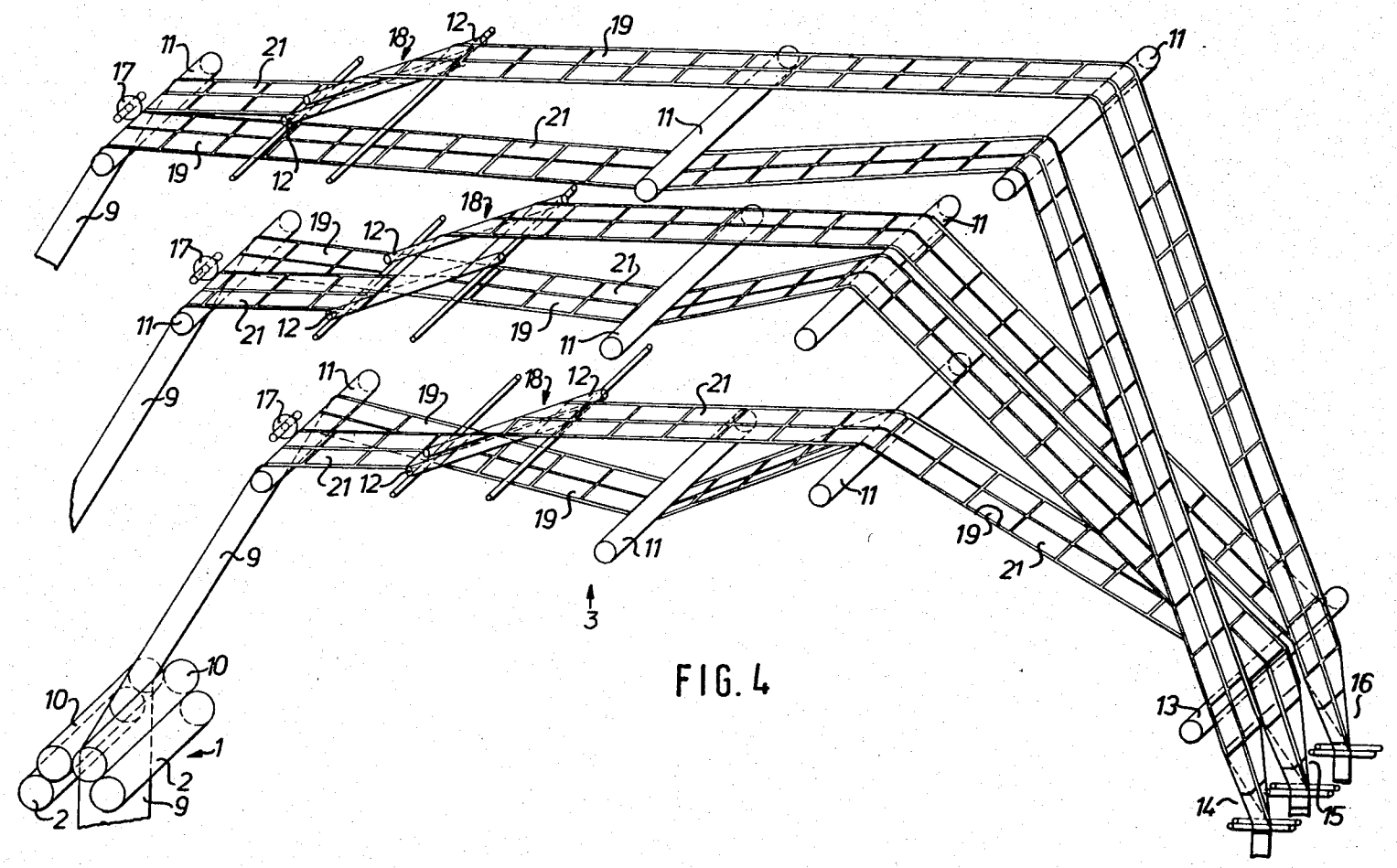
FIG. 4 is an overall perspective view of the paper web guiding mechanism in accordance with the present invention.

As may be seen in FIGS. 1 and 4, one of the paper web guiding mechanisms 3 in accordance with the present invention cooperates with each printing couple 1. Each such paper web guiding mechanism includes side frames 4 and 6 which are secured to the side frames 7 and 8 of the printing couple 1. At least one paper guide roller 11 is rotatably journaled in side frames 4 and 6 in any known manner. Each paper web 9 which is printed by and which exits from a printing couple 1 in the direction indicated by the arrows in FIG. 1, is guided by its own individual paper web guide mechanism 3 to a prefeed former roller 13 and from there through a plurality of formers 14, 15, and 16 for longitudinal folding and then into a folder generally at 20, all as may be seen in FIG. 2 with the direction of paper web travel again being denoted by arrows in FIG. 2.

The paper web guiding mechanisms 3 for the printing couples 1 are located at different levels and are generally positioned above and below each other. These paper web guiding mechanisms include the paper guide rollers 11 and turning bar pairs 18, as are shown in FIGS. 3A, 3C, 3D, 3E and 4. As was indicated previously in conventional paper web guiding mechanisms, the length of the paper guide rollers 11 is coordinated with the maximum width "a" of the paper web 9 being printed. In contrast, the paper guide rollers 11 of the paper web guiding mechanism 3 in accordance with the present invention have a width which is in excess of the inner width "b" of the printing couple 1 by an additional width "c" which may be one half of the width of the paper web 9 capable of being handled by the printing couple 1. The increased width "b" plus "c" is maintained by the paper web guiding mechanism 3 to the prefeed former roller 13.

Figure 3A:
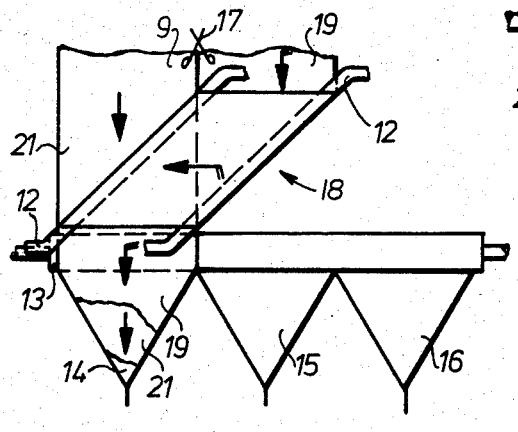
FIGS. 3A–3E are schematic views showing various possibilities of paper web mixing by use of the paper web guiding mechanism in accordance with the present invention.
Figure 3B:
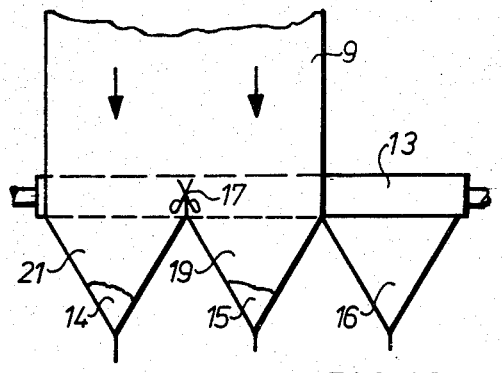
Figure 3C:
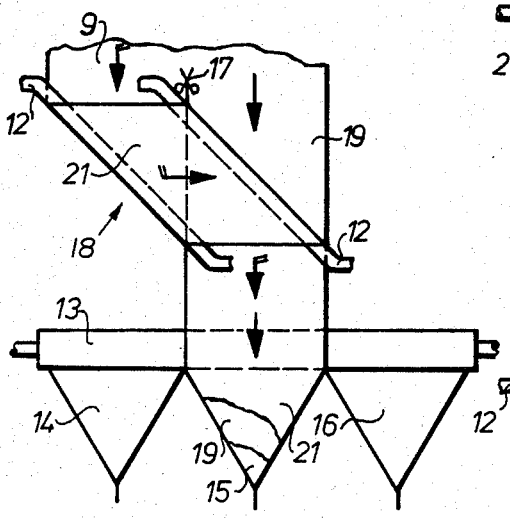
Figure 3D:
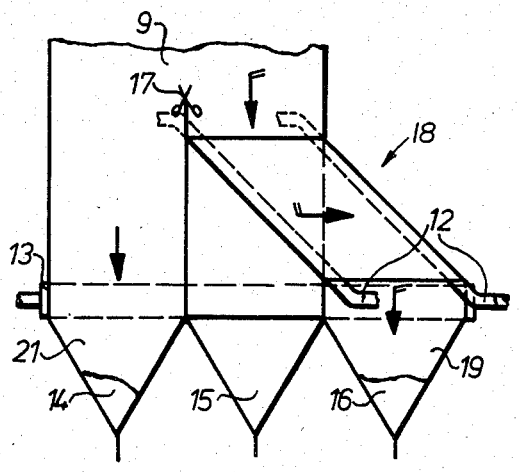
Figure 3E:
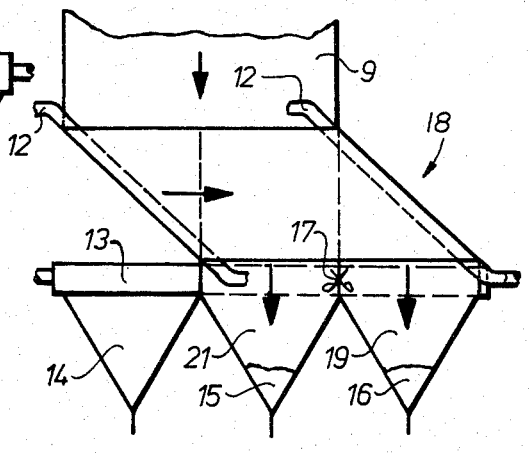

At least three formers 14, 15, and 16, which form longitudinal folds in the printed web 9, are positioned side by side in the same horizontal plane after the prefeed former roller 13. A double turning bar generally at 18 is provided for each paper web guiding mechanism 3 and is positioned between the printing couple 1 and the prefeed former roller 13. A driven, disengagable longitudinal slitting blade of generally known construction is also positioned adjacent the turning bar pair 18 in one of several possible positions, as are exemplified in FIGS. 3A–3E, and as may be seen in FIG. 4. Each slitter can be positioned as desired to slit the printed web either before or after the turning bars and before the prefeed former roller 13. The double turning bar 18 allows a partial web segment 19 that has been slit from the web 9 by blade 17 to be displaced parallel to the remaining portion 21 of the paper web 9. In one preferred embodiment, web 9 may be divided into a partial web 19 and a remainder web 21, each of which has a width "c" that is half of the width of the total web "a". As seen in FIG. 3A, this partial web 19 may be guided by the turning bars to a position parallel to the remainder web 21. At least one of the turning bars is capable of being disposed cross ways to the direction of paper web travel.

Each of the two turning bars 12 of the double turning bar 18 is disposed on guide supports secured to side frames 4 and 6 and is individually capable of being displaced along the entire length or width "b" plus "c" of the paper web guide mechanism 3. These turning bars 12 are further capable of being locked in a selected location. The position of the slitter 17 is also adjustable so that the printed web 9 can be split at a desired position and into desired separate widths.

The paper web guiding mechanism, in accordance with the present invention, makes it possible to feed the partial paper web 19 and the remainder 21 of web 9 to one of the formers 14, 15, and 16 which can be placed side by side. This is due to the increased width of the paper guide rollers 11 and the prefeed former roller 13. Accordingly, the printed paper web can be mixed in any of the various arrays as suggested in FIGS. 3A-3E. This increased roller width allows the formers to be placed at the same level and substantially reduces the height requirement of the machine.

While a preferred embodiment of a paper web guiding mechanism, in accordance with the present invention, has been fully and completely disclosed hereinabove, it will be obvious to one of skill in the art that a number of changes in, for example, the make up of the printing couple, the types of side frames and journal means and the like, could be made without departing from the true spirit and scope of the invention which is accordingly to be limited only by the appended claims.

We claim:

1. A paper web guiding mechanism for selectively guiding a paper web being printed in a web fed rotary printing machine which includes a printing couple having a width corresponding to the maximum width of the paper web being printed to at least one former, said paper web guiding mechanism comprising:

at least three formers positioned adjacent each other in the same horizontal plane and intermediate the printing couple of the printing machine and a folder, said plurality of formers having a combined width in excess of one and a quarter times the maximum width of the paper web being printed;

at least one longitudinal slitting means for slitting the paper web printed by the printing machine into a plurality of partial web segments, said slitting means being positioned intermediate said printing couple and said plurality of formers;

a plurality of paper guide rollers and a prefeed former roller disposed intermediate the printing couple and said formers, said paper guide rollers and said prefeed former roller each having a width generally the same as said combined width of said at least three formers and in excess of one and a quarter times the maximum width of the paper web printed by the printing machine, said prefeed former roller being positioned intermediate said slitting means and said formers; and turning bars for each of the paper webs printed by the printing machine, each of said turning bars being positioned intermediate said printing couple and said prefeed former roller, each of said turning bars further being supported for displacement along the entire width of said at least three formers and said plurality of paper guide rollers and prefeed roller to allow selective shifting of at least one of said partial web segments laterally with respect to said printing couple and parallel to a remainder portion of said paper web whereby the printed paper web can be mixed in various arrays.

2. The paper web guiding mechanism in accordance with claim 1 wherein at least one of the turning bars is capable of being disposed crossways to the direction of paper web travel.

* * * * *